US012693104B2

(12) United States Patent
Zhou et al.

(10) Patent No.: US 12,693,104 B2
(45) Date of Patent: Jul. 28, 2026

(54) EMERGENCY RESCUE SHAPED CHARGE CUTTING DEVICE WITH LIFE DETECTION FUNCTION

(71) Applicant: JIANGHAN UNIVERSITY, Wuhan City (CN)

(72) Inventors: Xiaoguang Zhou, Wuhan City (CN); Yongsheng Jia, Wuhan City (CN); Zhi Li, Wuhan City (CN); Yingkang Yao, Wuhan City (CN); Jinshan Sun, Wuhan City (CN); Quanmin Xie, Wuhan City (CN); Xiang Chen, Wuhan City (CN); Shaoyan Liu, Wuhan City (CN); Lijian Li, Wuhan City (CN)

(73) Assignee: JIANGHAN UNIVERSITY, Wuhan City (CN)

( * ) Notice: Subject to any disclaimer, the term of this patent is extended or adjusted under 35 U.S.C. 154(b) by 0 days.

(21) Appl. No.: 19/086,004

(22) Filed: Mar. 20, 2025

(65) Prior Publication Data

US 2026/0063408 A1 Mar. 5, 2026

(30) Foreign Application Priority Data

Aug. 27, 2024 (CN) ..... 202411184151.7

(51) Int. Cl.
*F42D 5/045* (2006.01)
*F42B 1/02* (2006.01)

(52) U.S. Cl.
CPC ..... *F42D 5/045* (2013.01); *F42B 1/02* (2013.01)

(58) Field of Classification Search
CPC ..... F42D 5/045; F42B 1/02
See application file for complete search history.

(56) References Cited

U.S. PATENT DOCUMENTS 3,712,221 A * 1/1973 Voigt, Jr. ..... F42D 5/045 102/307
3,778,010 A * 12/1973 Potts ..... B64C 1/1476 244/121

(Continued)

FOREIGN PATENT DOCUMENTS

CN 113396205 A 9/2021
CN 115551636 A 12/2022

(Continued)

*Primary Examiner* — Michelle Clement
(74) *Attorney, Agent, or Firm* — Maschoff Brennan

(57) ABSTRACT

Disclosed is an emergency rescue shaped charge cutting device with life detection function including a life detection device and a shaped charge cutting device body. The life detection device body is arranged on the inner or outer side of the shaped charge cutting device body. The shaped charge cutting device body includes a protective cover, a shaped charge cutting rope and a fuze system. The shaped charge cutting rope is embedded in the front side of the protective cover, and the detonating end of the fuze system penetrates into the interior of the protective cover from the rear side of the protective cover to be connected to the shaped charge cutting rope. Accordingly, the life detection device may be combined with the shaped charge cutting device to detect living beings and achieve precise blasting, thereby coordinating operation of the two devices and improving rescue efficiency.

10 Claims, 2 Drawing Sheets

(56) References Cited

U.S. PATENT DOCUMENTS 3,885,761 A * 5/1975 Pendergast ..... B64C 1/32 102/314
4,080,898 A * 3/1978 Gieske ..... F42B 1/028 102/306
4,418,622 A * 12/1983 Foster ..... F42B 1/02 102/307
4,499,828 A * 2/1985 Honodel ..... F42B 3/00 102/202.13
4,856,430 A * 8/1989 Gibb ..... F42B 3/08 89/1.14
4,905,601 A * 3/1990 Gabriel ..... F42B 3/08 102/302
5,170,004 A * 12/1992 Garrison ..... F42B 15/38 102/306
5,524,546 A * 6/1996 Rozner ..... F42B 3/08 102/302
5,954,296 A * 9/1999 Jahsman ..... B64C 1/32 244/121
6,494,139 B1 * 12/2002 Powell ..... F42B 12/10 175/4.6
7,000,545 B2 * 2/2006 Sansolo ..... F42B 3/00 102/305
7,337,703 B2 * 3/2008 Sansolo ..... F42B 1/036 102/307
7,536,956 B2 * 5/2009 Sammons ..... F42B 1/032 102/306
7,555,986 B2 * 7/2009 Givens ..... F42D 3/02 148/194
7,819,063 B1 * 10/2010 Lehman ..... B26F 3/04 102/323
8,006,621 B1 * 8/2011 Cherry ..... F42B 1/028 102/307
8,146,503 B2 * 4/2012 Murray ..... C06C 5/04 102/306
8,215,235 B2 * 7/2012 Moore ..... F42B 1/02 102/305
8,365,666 B1 * 2/2013 Hooke ..... F41H 13/00 102/317
8,727,060 B1 * 5/2014 Erickson ..... B60R 21/00 30/367
9,175,936 B1 * 11/2015 Collier ..... F42B 1/032
9,175,938 B2 * 11/2015 Barnette ..... B23K 23/00
9,175,940 B1 * 11/2015 Collier ..... F42B 1/028
9,291,435 B2 * 3/2016 Scheid ..... F42B 1/036
9,291,439 B2 * 3/2016 Murray ..... F42D 3/04
9,335,132 B1 * 5/2016 Collier ..... F42B 1/032
9,612,093 B2 * 4/2017 Collier ..... F42B 33/00
9,612,094 B1 * 4/2017 Collier ..... F24B 1/028
9,651,263 B2 * 5/2017 Collier ..... F42B 1/036
9,683,825 B2 * 6/2017 Murray ..... F42B 3/087
9,702,663 B2 * 7/2017 Rabec Le Gloahec ..... F42B 33/06
10,900,756 B2 * 1/2021 Murray ..... F42B 3/093
11,255,646 B2 * 2/2022 Green ..... F42D 1/20
11,320,247 B2 * 5/2022 Thornhill ..... F42C 13/06
11,460,150 B2 * 10/2022 Lumley ..... F42B 1/02
11,719,517 B2 * 8/2023 Green ..... F42D 1/20 102/306
11,777,537 B2 * 10/2023 Otto ..... F42B 1/02 455/460
11,965,727 B2 * 4/2024 Herr ..... F42D 1/22
2005/0126420 A1 * 6/2005 Givens ..... F42D 3/00 102/310
2010/0206159 A1 * 8/2010 Wang ..... F42D 5/045 102/303
2023/0142872 A1 * 5/2023 Alfadil ..... B64D 11/00 244/122 AE
2025/0187557 A1 * 6/2025 Rusu ..... B60R 21/0132

FOREIGN PATENT DOCUMENTS

CN 116199557 A 6/2023
CN 118976433 A 11/2024

* cited by examiner

EMERGENCY RESCUE SHAPED CHARGE CUTTING DEVICE WITH LIFE DETECTION FUNCTION

CROSS-REFERENCE TO RELATED PATENT APPLICATIONS

This application claims a priority from the Chinese Patent Application No. 202411184151.7, filed with the Chinese Patent Office on Aug. 27, 2024, entitled "EMERGENCY RESCUE SHAPED CHARGE CUTTING DEVICE WITH LIFE DETECTION FUNCTION", content of which is incorporated herein by reference in its entirety.

FIELD OF THE INVENTION

The disclosure relates to the technical field of emergency rescue device, in particular to an emergency rescue shaped charge cutting device with life detection function.

BACKGROUND OF THE INVENTION

In various natural disasters and man-made accidents, the trapped people are often located in environments with complex structures, such as inside collapsed buildings or in confined spaces. One of the main challenges faced by the rescue work is how to quickly and safely reach the position of the trapped people and carry out the rescue in time. For example, in the scenarios of a fire or some building collapse accidents, it is necessary to quickly find the position of the trapped people, and quickly open up rescue and escape passages. During the rescue operation, it is required to be able to accurately and precisely detect the trapped people, and at the same time, cut out suitable passages in the building structures around the trapped people. The existing rescue device usually has a single-function, for example, a cutting device which can only perform cutting operations and is unable to provide life detection information. Different rescue devices need to be carried and operated separately, which is not convenient for coordinated operation, increasing the burden on the rescue team and reducing the rescue efficiency. In addition, the shock waves generated by conventional explosives are likely to affect surrounding buildings, resulting in difficulty in rescue.

SUMMARY OF THE INVENTION

The purpose of the present disclosure is to provide an emergency rescue shaped charge cutting device with life detection function, so as to realize the rapid destruction of doors or walls in one area while detecting living beings, thereby improving the rescue efficiency.

According to the present disclosure, there is provided an emergency rescue shaped charge cutting device with life detection function including a life detection device and an shaped charge cutting device body, in which the life detection device is arranged on the inner side or the outer side of the shaped charge cutting device body, the shaped charge cutting device body includes a protective cover, an shaped charge cutting rope and a fuze system, the shaped charge cutting rope is embedded in the front side of the protective cover, and the detonating end of the fuze system penetrates into the interior of the protective cover from the rear side of the protective cover to be connected to the shaped charge cutting rope.

Further, the shaped charge cutting rope includes a protective sleeve, an explosive and a shaped charge liner, in which the shaped charge liner is clamped at the open end of the protective sleeve, and the explosive is arranged between the shaped charge liner and the protective sleeve.

Further, the fuze system includes an initiator and an electronic detonator, in which the initiator is connected to the electronic detonator through an initiating cable, and one end of the electronic detonator penetrates into the interior of the protective sleeve to be contact with the explosive.

Further, it also includes a support frame including a frame and a retractable support rod, in which the support rod is hinged to the frame, and each corner of the outside of the frame is provided with a clamping angle plate for mounting the protective cover.

Further, the shaped charge liner is a multi-layer composite type of shaped charge liner including an outer layer liner, a middle layer liner and an inner layer liner, in which each layer is connected by laser welding.

Further, the outer layer liner is made of aluminum or magnesium alloy material, the middle layer liner is made of copper or copper alloy material, and the inner layer liner is made of tantalum or tungsten alloy material.

Further, the outer layer liner and the middle layer liner have a porous structure.

Further, the surface of the shaped charge liner is provided with micro-grooves or micro-holes.

Further, the protective sleeve has a double-layer structure, in which an outer-layer is a high-density polymer layer, and an inner-layer is an elastic layer.

Further, the life detection device is an acoustic life detector or a radar life detector.

The beneficial effects of the present technical solution are as follows. According to present technical solution, the life detection device is combined with the shaped charge cutting device. While living beings are detected, precise blasting is achieved, and the coordinated operation of the two functions is realized, thereby improving the rescue efficiency. Once the life detection device detects a living being, the position of the shaped charge cutting device is fixed immediately. Then the fuze system is used to detonate the explosive in the shaped charge cutting rope to form a jet, which can cut through doors or walls. Moreover, the protective cover is used to absorb the shock wave after the explosion, preventing it from impacting the surrounding buildings and operators.

BRIEF DESCRIPTION OF THE DRAWINGS

In order to explain the embodiments of the present disclosure or the technical solutions in the prior art more clearly, the drawings needed to be used in the description of the embodiments or the prior art will be briefly introduced below. Obviously, the drawings in the following description are only some embodiments of the present disclosure. For those of ordinary skill in the art, other drawings can be obtained based on these drawings without creative labor.

Reference signs are denoted as follows: 1—frame, 2—protective cover, 3—shaped charge cutting rope, 301— protective sleeve, 302—explosive, 303—shaped charge liner, 4—clamping angle plate, 5—support rod, 6—life detection device, 7—diagonal support rod, 8—jet hole.

DETAILED DESCRIPTION OF THE INVENTION

The technical solutions in the embodiments of the present disclosure will be clearly and completely described below with reference to the accompanying drawings in the embodiments of the present disclosure. Obviously, the described embodiments are only some of the embodiments of the present disclosure, rather than all the embodiments. Based on the embodiments of the present disclosure, all other embodiments obtained by those of ordinary skill in the art without creative labor fall within the scope of protection of the present disclosure.

In the description of the present disclosure, it should be understood that the terms "center", "longitudinal", "lateral", "length", "width", "thickness", "up", "down", "front", "back", "left", "right", "vertical", "horizontal", "top", "bottom", "inside", "outside", "clockwise", "counterclockwise" and the like indicate positions or positional relationships based on the positions or positional relationships shown in the accompanying drawings, which are only for the convenience of describing the present disclosure and simplifying the description, rather than indicating or implying that the device or element referred to must have a specific orientation, be constructed and operated in a specific orientation, and therefore cannot be understood as limiting the present disclosure.

In addition, the terms "first" and "second" are only used for descriptive purposes, and cannot be understood as indicating or implying relative importance or implicitly indicating the number of technical features indicated. Thus, the features defined as "first" and "second" may explicitly or implicitly include one or more of the features. In the description of the present disclosure, the meaning of "multiple" is two or more, unless otherwise clearly and specifically defined. In addition, the terms "mounted", "connected" and "connection" should be understood in a broad sense, for example, it can be a fixed connection, a detachable connection, or an integral connection; it can be a mechanical connection or an electrical connection; it can be a direct connection or an indirect connection through an intermediate medium, or it can be the internal communication of two components. For ordinary technicians in this field, the specific meanings of the above terms in the present disclosure can be understood according to specific circumstances.

Embodiment 1

Figure 1:
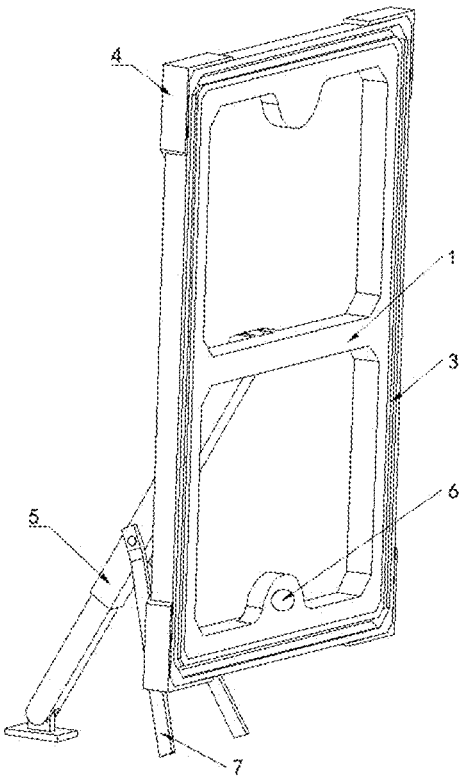
FIG. 1 is a schematic diagram of the overall structure of the present disclosure.
Figure 2:
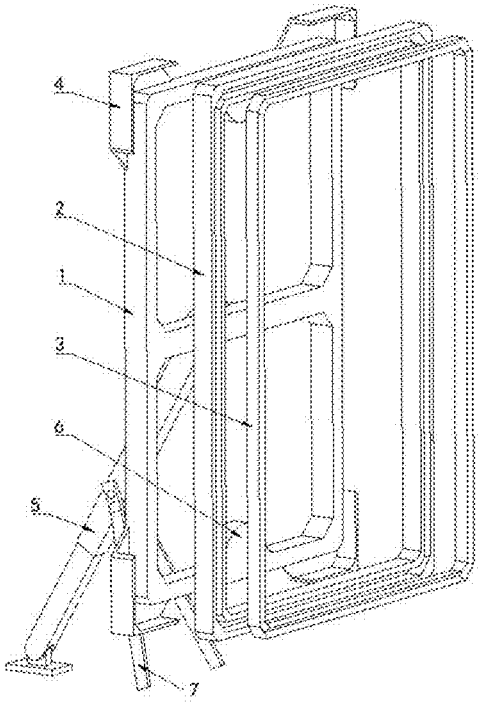
FIG. 2 is a disassembled view of the overall structure of the present disclosure.
Figure 3:
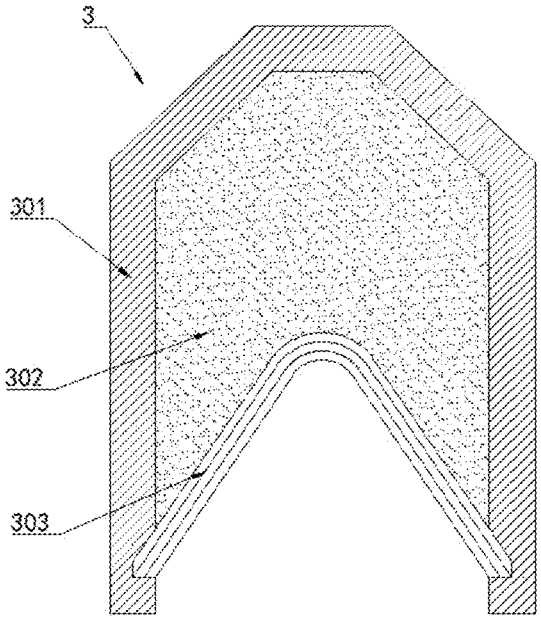
FIG. 3 is a schematic diagram of the cross-sectional structure of the shaped charge cutting rope in the present disclosure.

As shown in FIGS. 1 to 3, the present disclosure provides an emergency rescue shaped charge cutting device with life detection function, which includes a life detection device 6 and an shaped charge cutting device body. The shaped charge cutting device body has an annular structure with a hollow center. The life detection device 6 is arranged on the inner side or the outer side of the shaped charge cutting device body. The life detection device 6 is an acoustic life detector or a radar life detector. The acoustic life detector captures the sound waves or vibration signals generated by heartbeat, breathing, sounds (such as cries for help or knocking sounds), etc. The radar life detector uses radar waves to detect the existence of living beings and determine the position of the living beings by analyzing the reflected signals. The position of living beings can be detected in the event of a fire or building collapse.

The shaped charge cutting device body includes a protective cover 2, an shaped charge cutting rope 3 and a fuze system. There is an embedded groove on the front side of the protective cover 2. The shaped charge cutting rope 3 is embedded in the embedded groove on front side of the protective cover 2. The protective cover 2 plays a protective role, which can absorb shock waves and prevent the scattering of explosion products. The shaped charge cutting rope 3 includes a protective sleeve 301, an explosive 302 and a shaped charge liner 303. One side of the protective sleeve 301 is a closed structure and the other side is an open structure. Grooves are symmetrically arranged on the inner wall of the open end of the protective sleeve 301. The two ends of the shaped charge liner 303 are respectively clamped in the two grooves, and the explosive 302 is arranged between the shaped charge liner 303 and the protective sleeve 301.

The cross section of the shaped charge liner 303 is of a conical structure, and the top of the conical structure adopts a hemispherical transition structure. The shaped charge liner 303 in this embodiment is a multi-layer composite type of shaped charge liner 303, which includes an outer layer liner with a thickness of 0.5 mm, a middle layer liner with a thickness of 1 mm, and an inner layer liner with a thickness of 1.5 mm. Each layer is connected by laser welding. The middle layer liner is located between the inner-layer and the outer-layer, which plays a transition role and improves the stability of the jet. The outer layer liner is located at the outermost side, forming the head of the jet and improving the initial velocity of the jet. The outer layer liner is usually made of materials with low density and good plasticity, such as aluminum, magnesium alloy, etc. These materials can form a stable head of the jet and help to improve the initial velocity of the jet. For the middle layer liner, materials with moderate density and good plasticity can be selected, such as copper or copper alloy, which helps to improve the overall quality and stability of the jet. The inner layer is made of high-density materials, such as tungsten alloy or tantalum, to increase the penetration of the jet. The density of each layer of material gradually increases along the thickness direction, making the shaped charge liner 303 form a gradient material structure. The inner layer liner is in close contact with the explosive 302 and is responsible for converting the explosion energy into a high-speed jet. When the explosive 302 is detonated, the energy generated by the explosion first acts on the inner layer liner, causing it to deform rapidly and form a high-speed jet. The middle layer liner and the outer layer liner then participate in the formation process of the jet, and act on the jet together through their respective characteristics to improve the speed, stability and penetration of the jet.

The protective sleeve 301 in this embodiment can be set to a double-layer structure. The outer-layer is made of high-density polymers, such as polyurethane or polycarbonate, which have good energy-absorbing performance and flame retardancy. The inner-layer is an elastic layer made of rubber or special composite materials, which increases the elasticity of the protective sleeve 301 to better absorb explosion energy.

The detonating end of the fuze system penetrates into the interior of the protective cover 2 from the rear side of the protective cover be connected to the shaped charge cutting rope 3. The fuze system includes an initiator and an electronic detonator. The initiator is connected to the electronic detonator through an initiating cable. One end of the electronic detonator penetrates into the interior of the protective sleeve 301 to be contact with the explosive 302.

The device also includes a support frame, which includes a frame 1 and a retractable support rod 5. The life detection device 6 is arranged on the inner side of the frame 1. The support rod 5 is symmetrically hinged with diagonal support rods 7 on both sides to improve the stability of the entire device when it is fixed. The support rod 5 is hinged with the frame 1, and each corner on the outside of the frame 1 is provided with a clamping angle plate 4 for mounting the protective cover 2.

Embodiment 2

Figure 4:
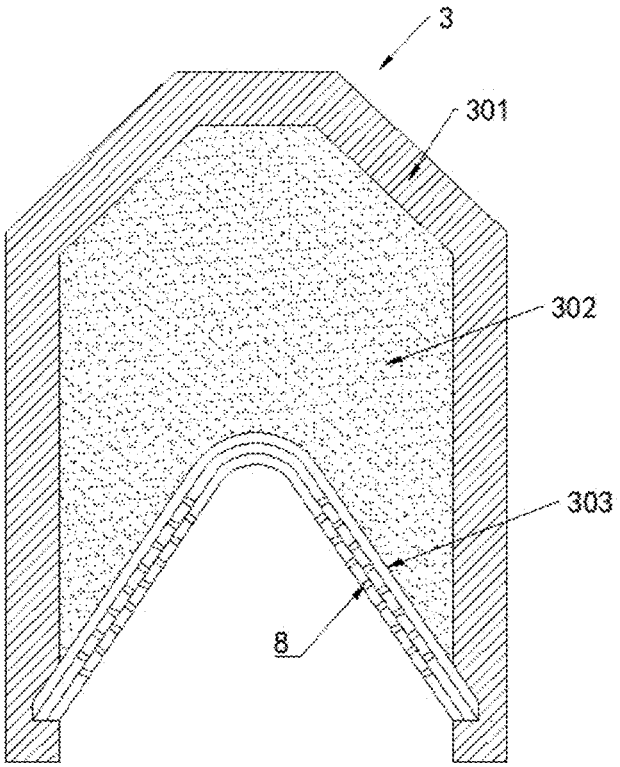
FIG. 4 is a schematic diagram of the cross-sectional structure of the cutting rope in Embodiment 2 of the present disclosure.

As shown in FIG. 4, compared with Embodiment 1, the difference in this embodiment lies in that the outer layer liner and the middle layer liner have a porous structure, that is, both the outer layer liner and the middle layer liner are provided with jet holes 8. Specifically, it can be designed as follows: the porosity of the outer layer liner is 20%, the porosity of the middle layer liner is 10%, the pore diameter of the outer layer liner is 0.5 mm, and the pore diameter of the middle layer liner is 0.3 mm. Adopting a porous structure for the outer layer liner or the middle layer liner can reduce the amount of material used and lighten the weight of the shaped charge liner 303. Meanwhile, the formation of the jet can be controlled through the change of the pore structure.

Embodiment 3

The difference of this embodiment from Embodiments 1 and 2 lies in that: micro-grooves or micro-holes at micron or nanometer scale are uniformly arranged on the surface of the outer layer liner of the shaped charge liner 303. Specifically, the design and layout are as follows: the width of the micro-grooves is 20 micrometers, the depth is 10 micrometers, and the spacing of the micro-grooves is 30 micrometers. This can improve the stability of the jet and reduce the dispersion of the jet.

Finally, it should be noted that the above embodiments are only used to illustrate the technical solutions of the present disclosure, rather than to limit it. Although the present disclosure has been described in detail with reference to the aforementioned embodiments, those skilled in the art should understand that they can still modify the technical solutions described in the aforementioned embodiments, or replace some or all of the technical features therein with equivalents. However, these modifications or replacements do not cause the essence of the corresponding technical solutions to deviate from the scope of the technical solutions of the embodiments of the present disclosure.

The invention claimed is:

1. An emergency rescue shaped charge cutting device with life detection function, comprising a life detection device body and a shaped charge cutting device body, wherein the life detection device body is arranged on an inner side or an outer side of the shaped charge cutting device body, the shaped charge cutting device body comprises a protective cover, a shaped charge cutting rope and a fuze system, the shaped charge cutting rope is embedded in a front side of the protective cover, and a detonating end of the fuze system penetrates into an interior of the protective cover from a rear side of the protective cover to be connected to the shaped charge cutting rope.

2. The emergency rescue shaped charge cutting device with life detection function according to claim 1, wherein the shaped charge cutting rope comprises a protective sleeve, an explosive and a shaped charge liner, the shaped charge liner is clamped at the open end of the protective sleeve, and the explosive is arranged between the shaped charge liner and the protective sleeve.

3. The emergency rescue shaped charge cutting device with life detection function according to claim 2, wherein the fuze system comprises an initiator and an electronic detonator, the initiator is connected to the electronic detonator through an initiating cable, and one end of the electronic detonator penetrates into the interior of the protective sleeve to be contact with the explosive.

4. The emergency rescue shaped charge cutting device with life detection function according to claim 1, further comprising a support frame comprising a frame and a retractable support rod, wherein the support rod is hinged to the frame, and each corner of the outside of the frame is provided with a clamping angle plate for mounting the protective cover.

5. The emergency rescue shaped charge cutting device with life detection function according to claim 2, wherein the shaped charge liner is a multi-layer composite type of shaped charge liner comprising an outer layer liner, a middle layer liner and an inner layer liner, and each layer is connected by laser welding.

6. The emergency rescue shaped charge cutting device with life detection function according to claim 5, wherein the outer layer liner is made of aluminum or magnesium alloy material, the middle layer liner is made of copper or copper alloy material, and the inner layer liner is made of tantalum or tungsten alloy material.

7. The emergency rescue shaped charge cutting device with life detection function according to claim 5, wherein the outer layer liner and the middle layer liner have a porous structure.

8. The emergency rescue shaped charge cutting device with life detection function according to claim 2, wherein the surface of the shaped charge liner is provided with micro-grooves or micro-holes.

9. The emergency rescue shaped charge cutting device with life detection function according to claim 2, wherein the protective sleeve has a double-layer structure, wherein an outer-layer is a high-density polymer layer, and an inner-layer is an elastic layer.

10. The emergency rescue shaped charge cutting device with life detection function according to claim 1, wherein the life detection device is an acoustic life detector or a radar life detector.

* * * * *